US011293459B2

(12) United States Patent
Tsui et al.

(10) Patent No.: US 11,293,459 B2
(45) Date of Patent: Apr. 5, 2022

(54) FAN DEVICE

(71) Applicant: NATIONAL CHIAO TUNG UNIVERSITY, Hsinchu (TW)

(72) Inventors: Yeng-Yung Tsui, Hsinchu (TW); Chi-Chuan Wang, Hsinchu (TW); Ting-Kai Wei, Hsinchu (TW); Hsueh-Han Chin, Hsinchu (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 499 days.

(21) Appl. No.: 16/533,163

(22) Filed: Aug. 6, 2019

(65) Prior Publication Data

US 2020/0047190 A1 Feb. 13, 2020

(30) Foreign Application Priority Data

Aug. 7, 2018 (TW) ..... 107127495

(51) Int. Cl.

| | |
|---|---|
| ***F04D 33/00*** | (2006.01) |
| ***B03C 3/45*** | (2006.01) |
| ***F04D 29/58*** | (2006.01) |
| ***F04D 29/66*** | (2006.01) |
| ***H01T 23/00*** | (2006.01) |
| ***H01T 19/00*** | (2006.01) |
| *B03C 3/38* | (2006.01) |

(52) U.S. Cl.

CPC ..... *F04D 33/00* (2013.01); *B03C 3/455* (2013.01); *F04D 29/58* (2013.01); *F04D 29/661* (2013.01); *H01T 19/00* (2013.01); *H01T 23/00* (2013.01); *B03C 3/38* (2013.01); *B03C 2201/14* (2013.01)

(58) Field of Classification Search

CPC ..... B03C 3/47; B03C 2201/14; F04D 33/00

See application file for complete search history.

(56) References Cited

U.S. PATENT DOCUMENTS

| | | | | | |
|---|---|---|---|---|---|
| 2,765,975 | A | * | 10/1956 | Lindenblad | F04D 33/00 315/111.91 |
| 3,638,058 | A | * | 1/1972 | Fritzius | H01T 23/00 313/359.1 |
| 3,896,347 | A | * | 7/1975 | Gelfand | B03C 3/70 96/28 |
| 4,063,826 | A | * | 12/1977 | Riepe | F04D 33/00 417/410.1 |
| 4,472,654 | A | * | 9/1984 | Nakamura | H03H 9/21 310/312 |

(Continued)

*Primary Examiner* — Kevin R Steckbauer

(74) *Attorney, Agent, or Firm* — Birch, Stewart, Kolasch & Birch, LLP

(57) ABSTRACT

A fan device including high voltage power source, conductive blade, first electrode and a resistance device is provided. Connecting side of the conductive blade is connected to first electric contact of the high voltage power source, and the conductive blade further includes a vibration side, wherein the conductive blade is extended from the connecting side to the vibration side along a first direction. The first electrode electrically connected to the second electric contact of the high voltage power source. The first electrode is disposed on a side of the vibration side of the conductive blade, and located in the vibrating range of the vibration side. The resistance device is connected between the conductive blade and the second electric contact in series.

8 Claims, 3 Drawing Sheets

(56) References Cited

U.S. PATENT DOCUMENTS 4,498,851 A * 2/1985 Kolm ..... F04D 33/00 310/331
4,643,745 A * 2/1987 Sakakibara ..... B03C 3/12 96/76
4,689,056 A * 8/1987 Noguchi ..... B03C 3/12 96/79
4,751,713 A * 6/1988 Affleck ..... H01S 3/036 372/59
4,780,062 A * 10/1988 Yamada ..... F04D 33/00 310/316.01
4,812,711 A * 3/1989 Torok ..... H01T 23/00 315/111.91
4,834,619 A * 5/1989 Walton ..... F04D 33/00 416/81
4,923,000 A * 5/1990 Nelson ..... F04D 33/00 165/122
5,008,582 A * 4/1991 Tanuma ..... H01L 23/467 257/E23.099
5,382,864 A * 1/1995 Morikawa ..... H01L 41/094 310/332
5,449,493 A * 9/1995 Rokugawa ..... B01F 31/445 422/500
5,522,712 A * 6/1996 Winn ..... F04D 33/00 310/25
5,861,703 A * 1/1999 Losinski ..... H01L 23/467 310/330
6,043,978 A * 3/2000 Mody ..... H01H 9/52 361/690
6,713,942 B2 * 3/2004 Raman ..... F04D 33/00 310/311
7,031,155 B2 * 4/2006 Sauciuc ..... F04D 33/00 257/722
7,061,161 B2 * 6/2006 Scher ..... F04D 33/00 310/328
7,282,837 B2 * 10/2007 Scher ..... F04D 33/00 310/328
7,358,649 B2 * 4/2008 Scher ..... F04D 33/00 310/328
7,417,359 B2 * 8/2008 Scher ..... H01L 41/0993 310/328
7,538,476 B2 * 5/2009 Chrysler ..... F04D 33/00 310/328
7,619,894 B2 * 11/2009 Wang ..... F04D 29/582 165/122
7,638,928 B2 * 12/2009 Palanduz ..... H01L 41/338 310/328
8,106,567 B2 * 1/2012 Eichhorner ..... F04D 33/00 310/330
8,247,954 B2 * 8/2012 Kagayama ..... B06B 1/0603 310/351
8,322,889 B2 * 12/2012 Petroski ..... F04D 33/00 362/294
8,373,963 B2 * 2/2013 Katano ..... H01T 23/00 361/231
8,929,049 B2 * 1/2015 Yagi ..... H05H 1/2406 361/231
9,011,113 B2 * 4/2015 Ma ..... F04D 33/00 417/410.2
9,620,936 B2 * 4/2017 Katano ..... F24F 8/192
9,644,624 B2 * 5/2017 Tanaka ..... F04B 43/046
9,702,357 B2 * 7/2017 Tsai ..... G06F 1/20
9,705,067 B2 * 7/2017 Tanaka ..... F04D 33/00
9,788,457 B2 * 10/2017 Hessling von Heimendahl ..... H05K 7/20145
9,932,992 B2 * 4/2018 Takeda ..... F04D 25/08
10,804,783 B2 * 10/2020 Feng ..... F04D 25/0606
10,870,100 B2 * 12/2020 Katano ..... A61L 9/046
10,938,188 B2 * 3/2021 Lin ..... H01T 19/00
11,070,034 B2 * 7/2021 Kinoshita ..... H05H 1/2406
11,215,200 B2 * 1/2022 Hao ..... F04B 45/047
2002/0175597 A1 * 11/2002 Raman ..... H01L 41/08 310/328
2007/0090726 A1 * 4/2007 Morris ..... F04D 33/00 310/330
2007/0182286 A1 * 8/2007 Scher ..... F04D 33/00 310/328
2008/0238248 A1 * 10/2008 Chrysler ..... F04D 33/00 310/317
2009/0045700 A1 * 2/2009 Sasaki ..... H01L 41/094 310/348
2009/0213555 A1 * 8/2009 Wang ..... F04D 29/582 361/719
2010/0047092 A1 * 2/2010 Erturk ..... F04D 33/00 417/410.2
2011/0005733 A1 * 1/2011 Wada ..... H01L 23/467 165/121
2011/0014069 A1 * 1/2011 Wada ..... F04D 33/00 417/410.2
2011/0063800 A1 * 3/2011 Park ..... F04D 33/00 361/697
2012/0007742 A1 * 1/2012 Gooch ..... H01T 23/00 340/584
2012/0008248 A1 * 1/2012 Sawyer ..... H05H 1/48 361/230
2012/0008249 A1 * 1/2012 Sawyer ..... H01T 23/00 361/230
2012/0300356 A1 * 11/2012 Katano ..... H01T 23/00 361/231
2013/0119264 A1 * 5/2013 Yagi ..... H05H 1/2406 250/423 R
2014/0166235 A1 * 6/2014 Hessling von Heimendahl ..... F04D 33/00 165/80.3
2014/0166260 A1 * 6/2014 Roebke ..... H05K 7/20209 165/244
2014/0169996 A1 * 6/2014 Tanaka ..... F04B 43/046 417/410.2
2014/0175948 A1 * 6/2014 Tanaka ..... H01L 41/094 310/330
2015/0152859 A1 * 6/2015 Tsai ..... F04D 33/00 416/3
2015/0173241 A1 * 6/2015 Hsu ..... G06F 1/203 165/287
2016/0111859 A1 * 4/2016 Katano ..... H01T 23/00 361/230
2016/0312802 A1 * 10/2016 Takeda ..... F04D 33/00
2019/0305524 A1 * 10/2019 Lin ..... H01T 19/04
2020/0047190 A1 * 2/2020 Tsui ..... H01T 23/00
2020/0052468 A1 * 2/2020 Kinoshita ..... H01T 23/00

* cited by examiner

FAN DEVICE

FIELD OF INVENTION

The present invention is related to a fan device; especially a fan device which generates corona wind.

BACKGROUND

The corona wind effect has been applied in various industries for many years. In the food industry, for instance, the corona wind equipment can be applied in the food drying process, preventing from temperature increasing during the process while saving energy. In Aerospace industry, the corona wind applied on the wings of aircrafts can produce airflow to achieve drag reduction. And in biomedical industry, the corona wind can even be applied in the fine powder production.

SUMMARY

The fan device of the present invention can not only generate corona wind but also further produce airflow to enhance the heat dissipation by vibration.

The fan device of the present invention includes a high voltage power source, a conductive blade, a first electrode and a resistance device. The connection side of the conductive blade is connected to the first electric contact of the high voltage power source and the conductive blade further includes vibration side, wherein the conductive blade extends to the vibration side along the first direction from the connection side. The first electrode electrically connected to the second electric contact of the high voltage power source. The first electrode is disposed beside the vibration side of the conductive blade, and is located in the vibration range of the vibration side. The resistance device is connected between the conductive blade and the second electric contact in series.

When the high voltage power source provides the second electric charge to the first electrode via the resistance device, the vibration side of the conductive blade is being attracted by the first electrode until they touched. The conductive blade bounces back after touching the first electrode due to electrical balance, the first electrode then resupplies the second electric charge from the high voltage power source to attract the vibration side, causing the vibration side waves back and forth.

In an example of the present invention, the fan device further includes a second electrode. The second electrode connects to the second electric contact of the high voltage power source, and the second electrode along the first direction remains a distance from the vibrating side. The high voltage power source forms potential difference between the second electrode and the conductive blade so as to generate corona wind transmitting to the second electrode.

In an example of the present invention, the high voltage power source causes positive or negative corona around the conductive blade.

In an example of the present invention, the resistance device is a variable resistance.

The resistance device provides a resistance between the conductive blade and the second electric contact, and the resistance device can adjust the magnitude of the resistance to control flow rate of the second electric charge being supply to the first electrode.

In an example of the present invention, the fan device further includes a frame. The frame is made of insulating material, and the connection side of the conductive blade is fixed on the frame.

In an example of the present invention, the conductive blade also includes a first and second surfaces being opposite to each other. The frame clips the first surface and the second surface of the connection side, and the first electrode is in the position of facing the first or the second surface of the vibration side.

In an example of the present invention, the resistance device includes glass-glaze high-voltage resistor.

In an example of the present invention, the materials of the conductive blade includes red copper, brass, beryllium copper or spring steel.

As seen above, the fan device of the present invention can generate the vibration of the conductive blade by the first electrode.

DETAILED DESCRIPTION OF THE PREFERRED EMBODIMENT

The fan device and the technical characteristics thereof of the present invention can be applied to the fan device which utilizes the vibration of the conductive blade to generate air flow; preferably, the fan device which can be applied to generate corona wind by the conductive blade, wherein the corona wind refers to the phenomenon of ionizing the dielectric between electrodes by a strong potential difference, and then generating other neutral gas molecules to flow by these ions based on electrohydrodynamic (EHD). The following will give examples to elaborate on the fan device of the present invention.

Figure 1:
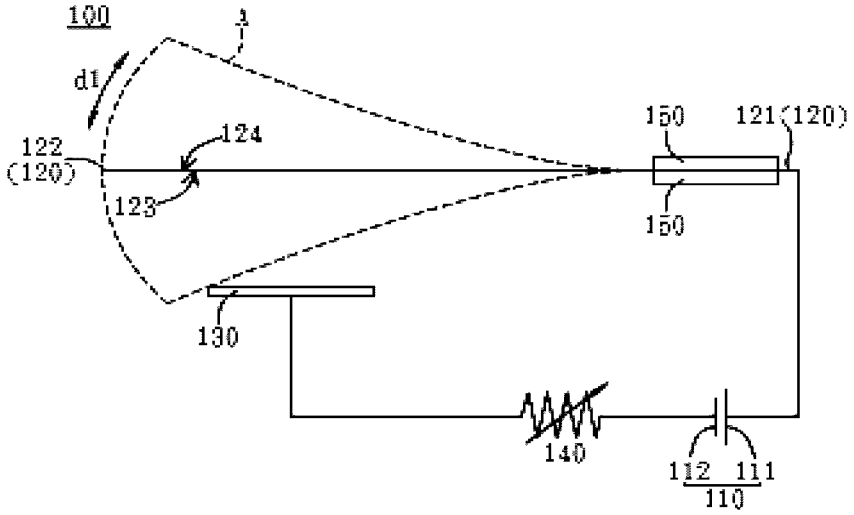
FIG. 1 is the schematic view of the fan device of the first embodiment of the present invention.

Please refer to FIG. 1, the drawing of the fan device 100 of the first embodiment of the present invention. The fan device 100 includes a high voltage power source 110, a conductive blade 120, a first electrode 130, and a resistance device 140.

The high voltage power source 110, for instance, can provide high voltage DC signals from 0 to 40 kV, preferably the positive high voltage DC power supply for corona wind which provides high voltage DC power signal ranged from 6 kV to 16 kV. The conductive blade 120 is vibrating blade made of metal, pure copper preferably. The conductive blade 120 includes connection side 121 and vibration side 122, and the conductive blade 120 extends to the vibration side 122 from the connection side 121 along the first direction (that is, the horizontal direction of FIG. 1) under a balanced status with neither power nor external force is applied. The first electrode 130 is, for instance, made of metal, a conductive metal plate capable of generating an induced voltage, preferably an conductive metal plate made of aluminum alloy.

The fan device further includes a frame 150 which is a fixed bracket made of insulating materials such as bakelite.

The frame 150 is used to fix the connection side 121 of the conductive blade 120 so that the conductive blade 120 and the high voltage power source 110 can be connected together, and, at the same time, allows the vibration side 122 to wave back and forth.

To be more explicit, the frame 150 of the example of the present invention is, for instance, used to fix the connection side 121 of the conductive blade 120 by clipping the first surface 123 and the second surface 124 of the conductive blade 120, preventing the unnecessary vibrations of the connection side 121 while the vibration side 122 vibrates. However, the present invention is not limited to the way that the frame 150 fixes the conductive blade 120, person having ordinary skill in the art can make use of other items such as colloid or fastener to fix the connection side 121 of the conductive blade 120, the present invention is not limited thereto.

When the high voltage power source 110 provides the voltage to the conductive blade 120, the first electrode 130 also generates induced voltage and, in turn, the blade is bent by the Coulomb force. The first electrode 130 is connected to the second electric contact 112 of the high voltage power source 110 via the resistance device 140, thus the current received by the first electrode 130 can be controlled by the resistance device 140 connected between the first electrode 130 and the second electric contact 112 in series.

As seen above, when the high voltage power source 110 provides the power to the conductive blade 120 and the first electrode 130, the former bends toward the first electrode 130 until touched due to the Coulomb force. In other words, the first electrode 130 is disposed in the vibration range A of the conductive blade 120 waving along the direction d1, and the conductive blade 120 drawn by the Coulomb force can touch the first electrode 130. The first electrode 130 of the example is disposed beside the vibration side 122 facing the first surface 123, so that the vibration side 122 of the conductive blade 120 can bent by the Coulomb force. However, the position of the first electrode 130 of the present invention is not limited to the aforementioned first surface 123 or the second surface 124 as long as it is located on one side of the vibration side 122 and provides an appropriate Coulomb attraction.

Figure 2:
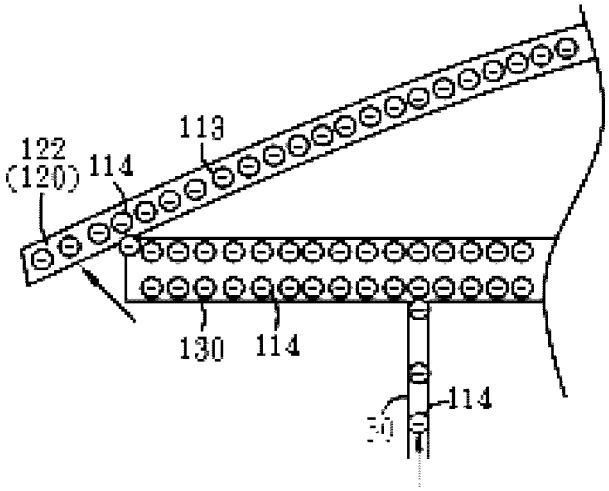
FIGS. 2 and 3 is the partial schematic view of the fan device of the first embodiment of the present invention.

To be more explicit, please refer to FIG. 2, as seen above, when the high voltage power source 110 provides the second electric charge 114 to the first electrode 130 via the second electric contact, the vibration side 122 of the conductive blade 120 will bend toward the first electrode 130 until touched because of the Coulomb force generated by the first electric charge 113. When the first electrode 130 touches the vibration side 122, the second electric charge 114 will be transmitted to the vibration side 122 to achieve electrical balance, and once the vibration side 122 and the first electrode 130 reach electrical balance, the Coulomb force will be reduced and the vibration side 122 will bounces back. However, in the above process, the second electric charge 114 carried on first electrode 130 continues to be provided via the wire 50, and the flow rate of the second electric charge 114 in the wire 50 is controlled by the resistance device 140. Therefore, while the conductive blade 120 reaching electrical balance and leaving the first electrode 130, the first electrode 130 continues to receive the second electric charge 114.

Figure 3:
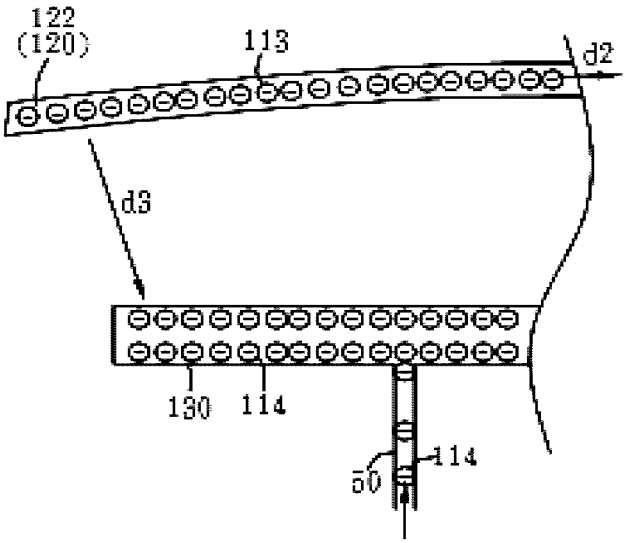

Please refer to FIG. 3, since the conductive blade 120 is connected to the first electric contact 111 of the high voltage power source 110, the second electric charge 114 carried on the conductive blade 120 is also transmitted to the high voltage power source 110 along the direction d2 via the connection side 121. Now, the first electrode 130 also continues to provide the second electric charge 114 via the electrically connected wire 50 of the high voltage power source 110, then the vibration side 122 of the conductive blade 120 and the first electrode 130 will be once again attracted to each other by the Coulomb force, and then vibrate toward the direction d3.

As seen above, by repeating the attraction of the Coulomb force on the first electrode 130 beside the vibration side 122 and the force of rebounding due to the flexibility of the material after touching the first electrode 130, the conductive blade 120 continues to vibrate within the vibration range A while the high voltage power source providing power, and then generates airflow. Meanwhile, the resistance device 140 can control current between the second electric type electrode 112 and the first electrode 130. And by increase or reduce the rate of flowing the second electric charge 114 to the first electrode 130, the resistance device 140 can adjust the vibration amplitude of the vibration side 112 so as to generate airflow which can provide function such as heat dissipation.

To be specific, the first electric contact 111 of the first embodiment of the present invention is, for instance, the positive contact of the high voltage power source 110; the second electric contact 112 is, for instance, the negative contact of the high voltage power source 110, namely the ground side. That is to say, the first electric charge 113 is, for instance, positive electrode; the second electric charge 114 is, for instance, free electron. When the vibration side 122 touching the first electrode 130, the electron 144 moves to the vibration side 122 to achieve electrical balance, and then causes the aforementioned vibration effect.

On the other hand, the resistance device 140 of the first embodiment of the present invention is, for instance, a variable resistance, preferably resistors connected in series which includes glass-glaze high-voltage resistor (the resistance is, for instance, 500M Ω), and is disposed on a silicone substrate with preferred insulation effect. The resistance device 140 can, for instance, be connected to the variable resistance which can reach to 50 GΩ in series, and the resistance device 140 is connected in the loop between the first electrode 130 and the second electric contact 112 (namely the ground side) of the high voltage power source 110 in order to control the surface potential of the first electrode 130 so that the amplitude of the vibration side 122 of the conductive blade 120 can be controlled.

Figure 4:
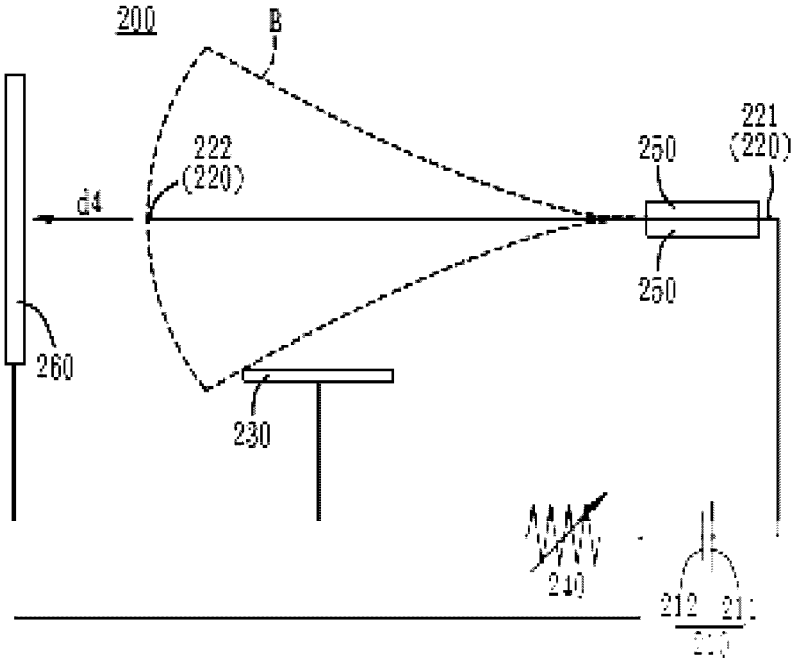
FIG. 4 is the schematic view of the fan device of the second embodiment of the present invention.

The technical characteristics of the fan device 100 of the first embodiment of the present invention is suitable for the generation of the corona wind, which will be explained with the following second embodiment of the present invention. Please refer to FIG. 4, fan device 200, like the aforementioned fan device 100, includes high voltage power source 210, conductive blade 220, first electrode 230, resistance device 240 and frame 250. The fan device 200 of the example further includes second electrode 260 which is connected to the second electric contact 212 of the high voltage power source 210, and remains a distance to the vibration side 222 along the first direction d4.

When the high voltage power source 210 of the example provides power signal, the conductive blade 220 connected to the first electric contact 211 and the second electrode 260 connected to the second electric contact 212 will form a potential difference. Preferably, since the high voltage power source provides high voltage DC, the conductive blade 220 and the second electrode 260 will form a high potential difference, allowing the conductive blade 220 to generate corona wind transmitting to the second electrode 260. To be more precise, the high voltage power source 210 of the example causes positive corona phenomenon around the conductive blade 220 and transmits the corona wind to the second electrode 260 along the direction d4, but the present invention is not limited thereto. In other examples, the high voltage power source can also causes negative corona phenomenon around the conductive blade.

In other words, based on the technical characteristics of the present invention, the fan device 200 of the second embodiment can not only provide corona wind but also generate airflow by vibrating the vibration side 222 within the vibration range B. When the fan device 200 of the second embodiment is applied to the heat dissipation device, the first electrode 230 and the second electrode 260 can allow the conductive blade 220 to provide preferable heat dissipation efficiency.

Figure 5:
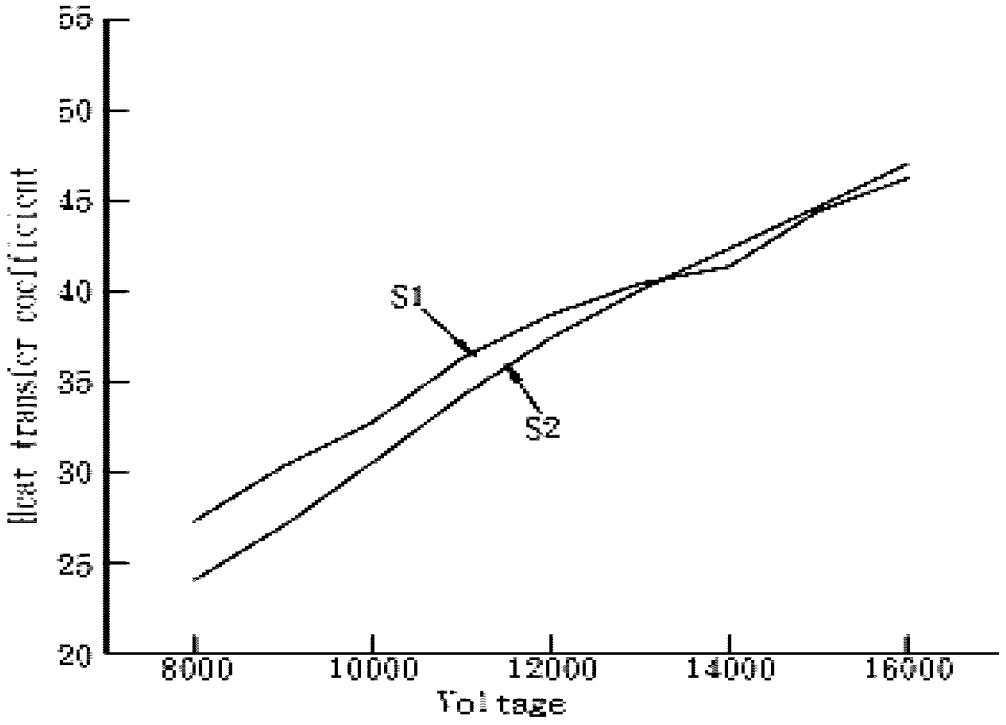
FIG. 5 is the heat transfer coefficient chart of the fan device of the second embodiment of the present invention and the pure corona heat dissipation device applied to heat dissipation.

Please refer to FIG. 5 which is exhibits average heat transfer coefficient comparison chart between the pure corona heat dissipation device and the fan device 200 of the second embodiment, wherein the unit of the voltage of the abscissa is V, that is, the voltage which is added to the corona wind electrode or the conductive blade 220; the unit of the thermal transfer coefficient of the ordinate is $W/m^2 \cdot K$; the data S1 is the heat transfer coefficient of the heat dissipation device to which the fan device 200 of the second embodiment is applied; data S2 is the heat transfer coefficient of the heat dissipation device to which the pure corona wind is applied. To tell from FIG. 5, the technical characteristics of the present invention allows the fan device 200 to perform preferably and provide better heat dissipation effect under relatively low voltage.

To sum up, the fan device of the present invention can provide corona wind while generating airflow by the vibration of the conductive blade, and, at the same time, the first electrode that drives the blade vibration can further control the amplitude of the conductive blade in order to provide appropriate heat dissipation effect.

The invention claimed is:

1. A Fan device comprising:

a high voltage power source;

a conductive blade, electrically connected to first electric contact of the high voltage power source, wherein the conductive blade includes a connection side and a vibration side, and the first electric contact is connected to the connection side, and the conductive blade is extended along a first direction between the connection side and the vibration side;

a first electrode, electrically connected to second electric contact of the high voltage power source, wherein the first electrode is disposed beside the vibration side and located in vibration range of the vibration side; a resistance device, connected between the conductive blade and the second electric contact in series; and a frame, configured to fix the connection side of the conductive blade;

wherein when the high voltage power source provides second electric charge to the first electrode via the resistance device, the vibration side of the conductive blade is being attracted by the first electrode until they touched;

the vibration side bounces back after touching the first electrode due to electrical balance, the first electrode then resupplies the second electric charge from the high voltage power source to attract the vibration side, causing the vibration side waving back-and-forth.

2. The fan device of claim 1, further comprising:

a second electrode, electrically connected to the second electric contact of the high voltage power source, wherein the second electrode along the first direction remains a distance from the vibration side, and the high voltage power source forms potential difference between the second electrode and the conductive blade so as to generate corona wind transmitting to the second electrode.

3. The fan device of claim 1, wherein the high voltage power source causes positive or negative corona around the conductive blade.

4. The fan device of claim 1, wherein the resistance device is a variable resistance and provides a resistance between the conductive blade and the second electric type electrode, and the resistance device is adapted to adjust the magnitude of the resistance so as to control flowing rate of the second electrical charge being supplied to the first electrode.

5. The fan device of claim 1, wherein the frame is made of insulating material.

6. The fan device of claim 5, wherein the conductive blade further includes a first surface and a second surface being opposite to each other, and the frame clips the first surface and the second surface of the connection side, wherein the first electrode is in the position of facing the first or the second surface of the vibration side.

7. The fan device of claim 1, wherein the resistance device includes glass-glaze high-voltage resistor.

8. The fan device of claim 1, wherein a material of the conductive blade includes red copper, brass, beryllium copper or spring steel.

* * * * *